US005950326A

United States Patent [19]

Scott

[11] Patent Number: 5,950,326

[45] Date of Patent: Sep. 14, 1999

[54] METHOD AND APPARATUS FOR RENEWING A ROOF SYSTEM

[76] Inventor: James Barry Scott, P.O. Box 336, Puxico, Mo. 63960

[21] Appl. No.: 08/383,191

[22] Filed: Feb. 3, 1995

[51] Int. Cl.[6] ..... F26B 7/00

[52] U.S. Cl. ..... 34/309; 34/310; 34/311; 34/104; 34/210

[58] Field of Search ..... 34/306, 309, 310, 34/311, 362, 380, 389, 446, 558, 582, 589, 86, 104, 201, 210; 52/746.11, 302.1, 302.6; 454/251, 186, 239

[56] References Cited

U.S. PATENT DOCUMENTS 3,633,659 1/1972 Ohlsson ..... 454/186 X 5,176,316 1/1993 Whitman ..... 454/239 X 5,487,247 1/1996 Pigg ..... 52/302.1 X

*Primary Examiner*—Henry Bennett

*Assistant Examiner*—Steve Gravini

*Attorney, Agent, or Firm*—Senniger, Powers, Leavitt & Roedel

[57] ABSTRACT

An apparatus for renewing a roof system of a building includes a blower having an intake port and an exhaust port in gaseous communication with the interior of the roof system to reduce the moisture content of the roof system. A method of renewing the roof system includes the steps of blowing air into the roof system until the roof system is dried to a predetermined level and applying a coating or second covering to the dried roof system.

13 Claims, 1 Drawing Sheet

METHOD AND APPARATUS FOR RENEWING A ROOF SYSTEM

BACKGROUND OF THE INVENTION (1) Field of the Invention

The present invention is directed to a method and apparatus for renewing a roof system. In particular, the apparatus of the present invention is used to prepare laminate roof systems for subsequent recovering by reducing the moisture content of the roof system. The method of the present invention includes both preparing and recovering the roof system.

(2) Description of the Related Art

There are many types of roof systems upon which the present invention may be used, however the invention is best suited for renewing various types of roof systems which typically cover commercial buildings. These commercial roof systems generally have a laminate construction, typically comprising a roof deck, an insulation material and a covering. The roof deck usually forms the bottom layer of the laminate roof system. The deck rests on joists which span the building and provide the majority of the structural support for the roof system. Typically, either steel sheets, composite wood panels, or solid wood boards are laid across the joists to form the roof deck. The insulation material is generally placed atop the roof deck and provides both thermal and acoustic insulation between the interior and exterior of the building. The covering is the top most layer of the typical laminate commercial roof system and may be tar, elastomeric sheet or any one of several other coverings which are well known in the art. The covering protects the roof deck and insulation material from the elements and prevents rainwater, melting snow and other moisture from penetrating the roof system. Thus, the covering keeps both the roof system itself and the interior of the building under the roof system dry.

Over time, due to the corrosive effects of the environment, as well as the deteriorative effects of ultraviolet radiation from the sun, the covering breaks down and permits moisture to penetrate into the roof system. If left unrepaired, the moisture will collect within the roof system and will ultimately drip into the interior of the building. Particularly corrosive environments may accelerate the deterioration of the covering. For instance, when the covering is used on roof systems in the vicinity of various chemical and manufacturing plants, the vapors exhausted from the plants can come in contact with the covering and cause the covering to deteriorate at an accelerated rate. Another common example of a particularly corrosive environment occurs on roof systems used to cover restaurants. The grease and oils emitted from fryers and grills during food preparation are usually exhausted to the roof of the restaurant where they collect and attack the roof system covering. Each of these particularly corrosive environments accelerate the degradation of the covering and thus shorten the serviceable life of the roof system by permitting moisture to penetrate the covering earlier than would otherwise occur. No matter which mode of attack occurs, when moisture penetrates the covering, the moisture is absorbed by the insulation material, and if the roof deck is made of wood, the moisture will be absorbed by the deck as well.

Most insulation material provides thermal insulation by pockets of stationary air held within voids formed in the material. These air pockets are highly resistant to the transfer of heat, but when moisture penetrates the insulation material, it displaces the air held in the voids. Because water has a lower thermal resistance than air, the penetration of the water reduces the thermal resistance of the insulation material and permits more heat transfer to occur through the roof system. As the transfer of heat through the roof system increases, the energy consumption required to heat and cool the building also increases. In addition, the increased moisture content provides a damp environment which fosters the growth of bacteria, mold and fungus, as well as many other undesirable plants and animals in and around the roof system. Further, moisture held in the insulation material accelerates the deterioration of the roof fastening or bonding system which holds the insulation material and covering to the deck and the deterioration of the roof deck, be it wood or steel.

In order to prevent the undesirable consequences of moisture penetration, a roof system must be repaired or replaced periodically. When a roof system is repaired or replaced, it is typically covered with a new covering to prevent moisture from penetrating into the insulation material and roof decking. In the past, if moisture had penetrated the insulation material and/or roof decking, the wetted roof system components such as the insulation material and roof deck had to be replaced prior to recovering the roof system. This additional step significantly increased the cost of repairing the roof system due to additional material and installation expenses.

Further, when the roof system components are replaced, they are generally disposed of in a landfill or other solid waste disposal site. However, there is a growing concern regarding the environmental impact of discarding what is perceived as being a large volume of solid waste. Thus, disposal of used roof system components has the potential to raise public concern. In addition, waste disposal adds cost to the replacement of roof systems because solid waste disposal sites charge for use of their facilities.

Some insulation materials which were commonly used in the construction of roof systems in the past have been found to present health hazards. In particular, asbestos has been found to cause asbestosis and other detrimental health effects when humans breath airborne asbestos fibers. Thus, if asbestos is present in the insulation material of the roof system, disturbing it during repair presents a health risk. Although there are methods for containing the airborne fibers, the cost associated with these methods further increases the cost of repairing the roof systems. Thus, it is preferable to leave roof system components in place during repair. However, in the past when moisture had penetrated the roof system components, leaving the components in place was not advisable for the reasons given above.

One other consideration must be taken into account when roof systems are repaired. Roofs must withstand loads caused by snow, wind and other types of indigenous environmental loads which are well known in the art, as well as loads due to saturation of the insulation material and roof deck. The joists which support the roof system provide a majority of the structural support to withstand these loads. The joists also provide most of the support to hold up the roof system itself. Thus, if the weight of the roof system is increased, the magnitude of the environmental loads which the joists can withstand is reduced because the strength of the joists is constant. Therefore, increasing the weight of the roof system during repair is undesirable.

SUMMARY OF THE INVENTION

The inventor has succeeded in developing a method and apparatus for repairing and renewing a roof system which offers reduced costs, decreased solid waste disposal and a reduced health risk as compared to previously known roof system repair and replacement methods. In addition, the roof system renewal may be accomplished without significantly increasing the load on the roof structure.

The apparatus of the present invention includes a blower which forces air between the layers of the roof system to quickly dry the roof system. Once dried, the various components of the roof system need not be replaced but instead may be left in place. Therefore, the expense of replacing these components may be avoided. Further, the components need not be taken to a waste disposal site thus presenting an environmental benefit and an additional cost benefit. In addition, because the insulation material need not be disturbed significantly during the roof system renewal, the potential health hazards previously associated with insulation material disturbance are virtually eliminated.

In the first step of the method of the present invention, the apparatus described above is used to dry the roof system if necessary. Once dry, the roof system may be recovered with any one of several well known coverings. For example, the roof system may be covered with a seamless coating such as an aliphatic urethane to prevent further moisture penetration and environmental attack. Use of a liquid coating such as the aliphatic urethane has the benefits of quick application and reduced labor cost. The drying apparatus described above may also be used to quickly cure the coating to reduce the repair time.

The resulting renewed roof system is restored to a serviceable condition at a significantly reduced cost, with a reduced environmental impact and with a reduced potential for health hazards. In addition, if a seamless liquid coating is used to recover the roof, the renewal does not significantly increase the roof system loads on the joists and therefore the strength of roof system is not compromised by the renewal process.

BRIEF DESCRIPTION OF THE DRAWINGS

Further objects and features of the present invention are revealed in the following Detailed Description of the Preferred Embodiment of the invention and in the drawing figures wherein.

DETAILED DESCRIPTION OF THE PREFERRED EMBODIMENT

Figure 2:
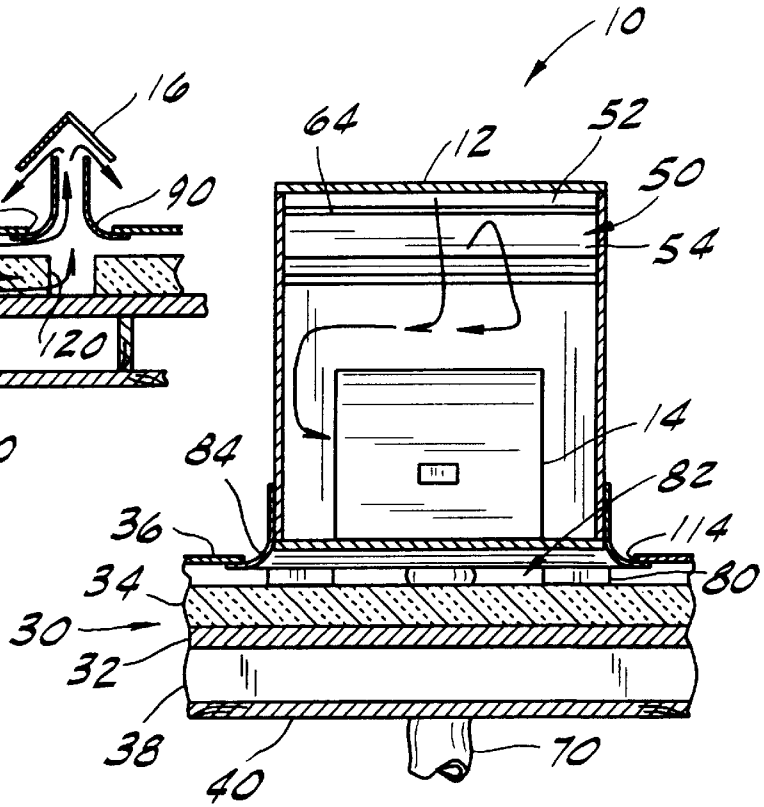
FIG. 2 is a cross-sectional view of the apparatus taken in the plane of line 2—2 of FIG. 1.

The roof renewal apparatus 10 of the present invention is generally comprised of a housing 12, a blower 14 and one or more exhaust vents 16. Although the apparatus 10 may be used on other types of roof systems with different constructions, the apparatus 10 of the preferred embodiment is primarily intended for use on commercial and industrial roof systems 30 similar to that shown in FIG. 1. However, as appreciated by those in the art, the apparatus 10 and method of the present invention have application to other roof system types as well.

Figure 1:
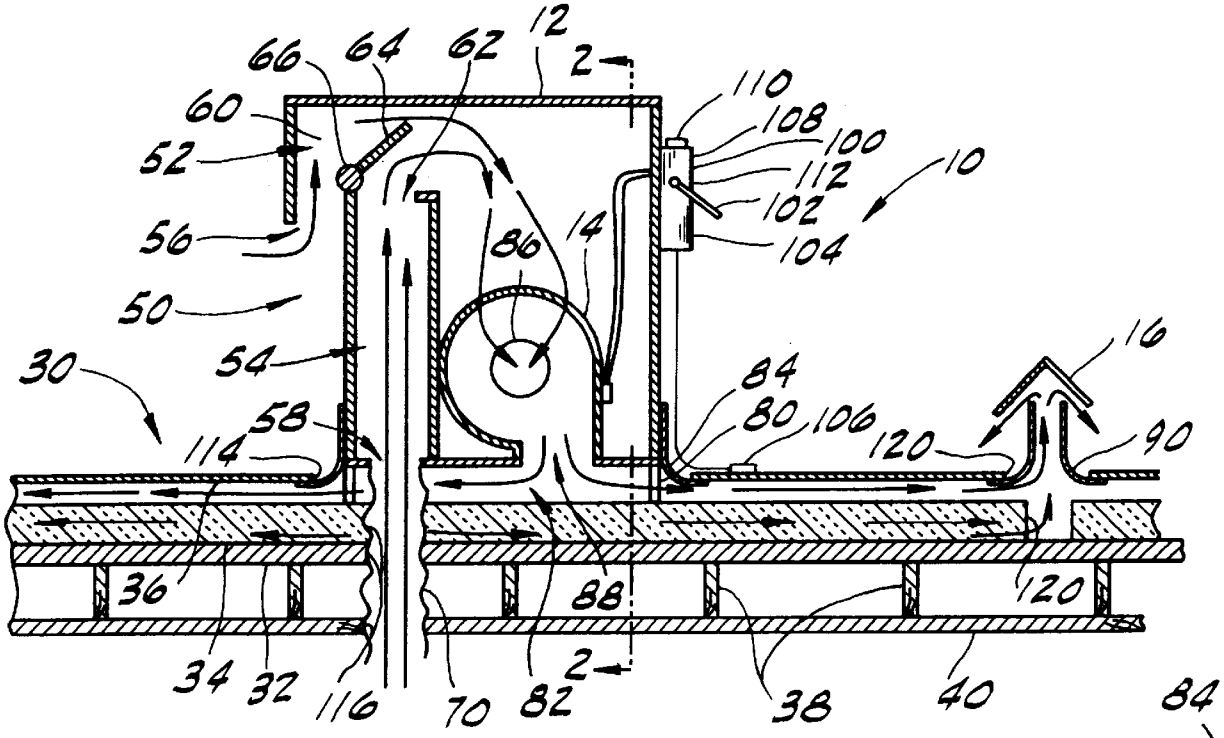
FIG. 1 is a cross-sectional view of the apparatus of the present invention mounted on a roof system being repaired.

Although variants are known, a typical commercial roof system 30 is shown in FIG. 1 and comprises a roof deck 32, insulation material 34 and a covering 36. The roof deck 32 spans joists 38 which extend between walls and/or columns of the building (not shown). In a typical commercial construction, the joists 38 are steel I-beams, steel truss work, or common dimensional lumber and the roof deck is plywood or other fabricated wood sheets, tongue and groove boards or steel sheets attached to the upper ends of the joists 38. The joists 38 and deck 32 form the load carrying structure of the roof and must withstand snow loads and other commonly occurring indigenous loads.

Any of several types of insulation material 34 usually cover the deck 32 of a typical commercial roof system 30. These various types of insulation material 34 range from one quarter inch to twelve inches thick or more depending upon the type of material used and the desired properties of the roof system. The insulation material 34 provides thermal and acoustic insulation which reduces the transmission of heat and sound through the roof system 30.

Typically, the covering 36 is positioned above the insulation material 34 and forms the top layer of the roof system 30 laminate. The covering 36 may be any of many commonly known types. Although the method and apparatus of the present invention may be used on tar roofs and other commonly used laminate roof systems, the method and apparatus are best suited for use with a single-ply membrane covering such as HYPALON synthetic elastomeric sheet. HYPALON is a U.S. federally registered trademark of E. I. duPont de Nemours & Co. It should be understood that the covering 36 usually lays directly on the insulation material 36, however the covering is shown raised above the insulation material in the figures to depict the approximate position of the covering relative to the insulation material when air is being blown between the covering and insulation material. A ceiling 40 is attached to the bottoms of the joists 38 in FIGS. 1 and 2, but the method works equally well if the ceiling is suspended below the joists or omitted entirely.

A common feature among all insulation materials 34 is that they are porous and have numerous voids throughout. These voids are filled with stationary air which has a high thermal resistance and which provides the majority of the thermal resistance of the insulation material. Water has a thermal resistance that is about ten times lower than that of air. When water penetrates the thermal insulation and displaces the entrapped air, the thermal resistance of the insulation is reduced. Thus, water penetration is undesirable.

The covering 36 acts to protect the insulation material 34 from the elements by preventing rainwater, melting snow and other water from penetrating the insulation material. Nonetheless, the covering 36 breaks down over time due to attack by ultraviolet radiation and other corrosive environmental characteristics. Thus, if not maintained, the covering will eventually permit moisture to enter the insulation material 34 thereby reducing the thermal effectiveness of the material. The method and apparatus of the present invention renews roof systems by removing any moisture from the insulation material 34 to restore the thermal effectiveness of the roof system and by repairing the damaged covering 36 to restore the moisture protection of the insulation material.

The housing 12 of the renewal apparatus 10 of the present invention is generally rectilinearly shaped and configured to sit upon the roof system 30. Alternately, the housing 12 may be modified to be suspended from beneath the roof system 30 or to be located remote from the roof system without departing from the scope of this invention. A bifurcated intake duct 50 is positioned on a side of the housing 12 opposite the blower 14. The bifurcated intake duct 50 includes an ambient air intake duct 52 and a conditioned air intake duct 54. Each of these ducts 52, 54 has an entrance 56, 58 adjacent the exterior of the housing 12 and an exit 60, 62 opposite the entrance as shown in FIG. 1. The entrance 56 of the ambient air intake duct 52 is turned downward to prevent rainwater from entering the housing 12 through the duct. The entrance 56 may also be covered by a screen (not shown) to prevent the ingestion of birds and other foreign objects into the housing 12 when the blower 14 is energized. A pivotable gate 64 separates the exits 60, 62. The gate 64 pivots relative to the housing 12 about the pivot rod 66 and may be positioned in any of an infinite number of positions to regulate the ratio of air entering the housing through the ambient air intake duct 52 and the conditioned air intake duct 54. A flexible duct 70 is connected to the lower end of the conditioned air intake duct 54 and extends through the roof system 30 to the interior of the building so that conditioned air may be drawn from within the building. Thus, depending upon the position of the pivotable gate 64, air may enter the housing 12 through the ambient intake duct 52 from an ambient air source outside the building or through the conditioned air intake duct 54 from a conditioned air source inside the building or simultaneously through both intake ducts 52, 54 in an infinitely variable ratio of ambient air and conditioned air.

The housing 12 rests upon four legs 80 proximate the corners of the housing to raise the housing above the surface of the insulation material 34 and to create an air space 82 beneath the housing. Flashing 84 is bonded to the lower edges of the housing 12 and extends beneath the covering 36 adjacent the housing to prevent fluid from entering and exiting through the joint created between housing 12 and covering 36. The flashing 84 of the preferred embodiment is a flexible gasket material which may be adhesively bonded and/or thermally welded to the housing 12 and the covering 36 to prevent moisture from entering the roof system 30 and to prevent air from exiting the roof system adjacent the housing 12. In an alternate embodiment, the flashing 84 may be metallic sheet or any other suitable material as is well known in the art.

The blower 14 of the preferred embodiment is a common two speed squirrel cage fan with a 700 cubic feet per minute flow rate capacity. However, depending upon the type of roof system upon which the apparatus 10 is being used and the back pressure inherent in the particular type of system, as well as other flow variables, the flow rate entering the roof system is typically between 300 and 500 cubic feet per minute in the preferred embodiment. Nonetheless, other flow rates and blower configurations are also intended to be within the scope of this invention. When the blower 14 is energized, air is drawn into the blower through the intake port 86 at the side of the blower and forced out the exhaust port 88 at the bottom of the blower and into the air space 82 beneath the housing.

In the preferred embodiment, several exhaust vents 16 may be positioned around the periphery of the roof system area to be dried, but these vents are optional and may be omitted without departing from the scope of the invention. If the vents 16 are omitted, holes (not shown) are made in the roof system to permit the air forced into the roof system to exhaust to ambient. In the best mode, the exhaust vents 16 are one directional roof system vents which are well known in the art and which permit air to escape but prevent air and other fluids such as rainwater to enter the roof system. As with the housing 12, flashing 90 is installed the exhaust vents 16 to produce a better fluid seal between the vents and the covering 36. After the roof system 30 is dried, the exhaust vents 16 may be left in place so that they continue to vent the roof system 30 as is well known in the art.

Several controls may be used to switch the blower 14 between an energized state wherein the air is drawn through the intake ducts 52, 54 and forced beneath the housing 12 and into the roof system 30 as indicated by the arrows in the figures and an unenergized state wherein the air is permitted to flow freely. One of the controls is a simple on-off switch 100 which permits the user to turn the blower on and off between the energized and unenergized states by throwing a switch lever 102 as is well known in the art. Another control which may be included in the system is a humidistat control 104 which includes a moisture sensor 106 mounted adjacent the covering 36. The moisture sensor 106 measures the moisture content of the roof system 30 and signals the humidistat control 104 to stop the blower 14 when the moisture content drops below a predetermined acceptable level. A photocell control 108 may also be used to control the blower 14. The photocell control 108 includes a photocell 110 which measures the amount of light hitting the photocell and signals the control 108 to stop the blower 14 when the sun goes down. Thus, in installations where it is unlikely that personnel will be present after sundown, the system is shut down to reduce the potential for fire hazard. Yet another control system which may be employed is a timer control 112 which turns the blower 14 on and off at predetermined time intervals. In addition, other control systems which are well known in the art may be used to switch the blower 14 between the energized and unenergized states.

To renew a typical commercial roof system 30 as described above, the user first determines the moisture content of the roof system. The moisture content may be measured using any one of several devices which are well known in the art. If the moisture content is below an acceptable level, the covering 36 may be repaired, supplemented or replaced without replacing the insulation material 34. The acceptable level of moisture content in the roof system 30 is approximately equal to the moisture content that the roof system would have on a local humid day if it had not been penetrated by water. Because the moisture content that a roof system would have on a humid day varies from region to region, the value of the acceptable level also varies from region to region.

In the best mode of the method of the present invention, an aliphatic urethane coating is painted onto the covering 36 to seal the roof system 30 from the elements. This coating has good corrosion and ultraviolet radiation resistance and is a fairly inexpensive material which is also inexpensive to install. Thus, the roof can be returned to a like-new condition at a fraction of the cost of replacing the original covering 36. This renewal is also accomplished without significantly increasing the load on the joists 38 that support the roof system 30 because the coating is light in weight when cured.

If the moisture content of the roof system 30 is above the acceptable level, a rectangular hole 114 is cut in the covering 36 in the area of the roof system having the highest moisture content. The hole 114 should have dimensions approximately equal to the dimensions of the footprint of the housing 12. Next, a circular hole 116 having a diameter approximately equal to that of the flexible duct 70 is bored through the insulation material 34, the roof deck 32 and, if necessary, the ceiling 40 and the flexible duct 70 is installed through the roof system 30 as shown in FIG. 1. The duct 70 is then connected to the conditioned air intake duct 54, and the housing 12 is positioned over the hole 114 in the covering 36. If required, the position of the housing 12 may be adjusted slightly because of the flexibility of the flexible duct 70. Flashing 84 is installed around the periphery of the housing 12 by adhesively bonding and/or thermally welding the flashing to the sides of the housing and to the underside of the covering 36 surrounding the hole 114. Any control sensors may be installed as required during the steps outlined above.

The exhaust vents 16 are installed around the perimeter of the areas to be dried as is well known in the art. To install the exhaust vent 16, a hole 120 having a diameter approximately equal to that of the exhaust vent is made in the covering 36 and the insulation material 34 in the location where the vent is desired. The exhaust vent 16 is positioned over the hole 120 in the covering 36 and insulation material 34 and is fastened to the roof deck 32 with fasteners (not shown) if desired. The exhaust vent flashing 90 is then adhesively bonded and/or thermally welded to the covering 36 surrounding the hole 120 to seal the periphery of the vent. If the vents 16 are intended to be permanent, fastening the vents to the roof deck is particularly desirable.

Once the apparatus 10 is installed as described above and shown in the drawing figures, the blower 14 is energized by turning the on-off switch lever 102 to the on position. Air is drawn into the housing 12 through the intake duct 50 by the blower 14 and is forced into the roof system 30. Depending upon the particular construction of the roof system 30, the air forced into the roof system will flow between the roof deck 32, insulation material 34 and covering 36, as well as through the insulation material itself as indicated by the arrows in FIG. 1 or between and through the other separable layers of other laminate roof systems. As the air is forced into the roof system 30, the covering 36 raises off of the insulation material 34 as shown in the figures if it is mechanically fastened. Otherwise, all air passes through the insulation and between the roof deck and insulation.

Initially, the gate 64 is positioned to block the exit 60 of the ambient air intake duct 52 so that air is only drawn from the inside of the building through the conditioned air intake duct 54. In other words, the gate 64 is initially rotated fully counter-clockwise as shown in FIG. 1. A pressure balance is taken between the interior and exterior of the building to assure that a negative pressure is not developed inside the building due to more air being drawn out of the building through the conditioned air intake duct 54 than is being piped into the building through the building ventilation system (not shown). A negative pressure causes air to be drawn into the building through the doors and windows in order to compensate for the air being drawn through the intake duct 54. A negative pressure condition is undesirable as insects and pollutants will be drawn in through open doors as persons enter and exit through them. If a negative pressure condition is found, the gate 64 is adjusted by rotating it clockwise as shown in FIG. 1 to permit air to enter the housing 12 through the ambient air intake duct 52. Because the amount of air being drawn into the housing 12 by the blower 14 is fairly constant, when the amount of air being drawn through the ambient air intake duct increases, the amount of air being drawn from the building decreases. Thus, the gate 64 is adjusted until the amount of air being drawn from the building through the conditioned air intake duct 54 is small enough to cause a sufficiently positive pressure condition inside the building.

The gate 64 adjustment process previously described is made in order to maximize the amount of conditioned air that is used. Conditioned air is generally dryer and/or warmer than the ambient air and thus drys the roof system quicker than ambient air. In addition, particularly in the winter months, the covering 36 becomes stiff due to the relatively cold ambient temperature. Warming the covering 36 by blowing conditioned air through the roof system 30 causes the covering to become more flexible and easier to work with. Further, warming the covering 36 has the advantage of reduced curing times for the adhesives and coatings which may be used later in the renewal process.

The blower 14 is energized until the moisture content of the roof system is below the acceptable value. Paving stones (not shown) or other weights may be laid atop the covering 36 to prevent the air from flowing to particular areas of the roof system 30 and to direct the air to other areas where the moisture content is higher. When the acceptable moisture content is achieved, the blower 14 is turned off and the apparatus 10 is disassembled and removed. Appropriate patches may then be made to cover the holes 114, 116, 120 in the roof system. The roof deck 32 may be patched by fastening or bonding a sheet of wood or metal over the hole 116 in the deck 32. The insulation material 34 removed from the roof system when the holes 116, 120 were made in the insulation material may be replaced to fill the holes and the covering 36 may be patched by any means that is well known in the art. Once the roof system 30 is dried and the holes 114, 116, 120 are patched, the covering 36 may be repaired, supplemented or replaced as described above. In particular, an aliphatic urethane coating may be painted onto the covering 36 to seal the roof system 30 from the elements.

Numerous alternate embodiments are also envisioned as being within the scope of this invention. For instance, the conditioned air intake duct 54 may be eliminated and a heater unit (not shown) may be placed in series with the ambient intake duct 52 to preheat the air entering the roof system 30. As mentioned earlier, preheating the air has the added benefit of heating the roof system 30 which improves the flexibility of the covering 36 and makes the covering easier to manipulate. In addition, heating the roof system causes the aliphatic urethane coating to cure faster. Further, addition of the heater eliminates the need to cut the hole 116 in the roof deck 32.

Another alternate embodiment of the apparatus 10 of the present invention includes an injection system mounted in series with the housing 12 to inject fumigants, fungicides, algicides, and/or bactericides into the air being blown through the roof system 30 to kill any unwanted plant or animal life present in the roof system. Plant and animal life in the roof system reduce the longevity and performance of the roof system. Thus, elimination of plant and animal life extends the longevity of the renewed roof system.

While the present invention has been described by reference to a specific embodiment, it should be understood that modifications and variations of the invention may be constructed without departing from the scope of the invention defined in the following claims.

What is claimed is:

1. Apparatus for renewing a roof system of a building, the roof system comprising a deck, an insulation material and a covering, the apparatus being adapted to renew the roof system without substantially removing the covering from the roof system and without substantially separating the covering from the insulation material when installing the apparatus on the roof system, the apparatus comprising a blower having an intake port communicating with an intake source including a first source external to the building and a second source internal to the building and an exhaust port for communicating with the roof system, and a housing surrounding the blower having a seal for substantially preventing air from traveling between the blower exhaust port and the roof system covering to escape from the roof system, the blower having an energized state wherein the blower draws air through the intake port and forces the air into the roof system under a sufficient pressure to force the air through the roof system thereby to dry the roof system, and wherein the apparatus is free of conduits internal to the roof system and the air forced into the roof system passes directly into the roof system at a location in the roof system immediately adjacent the seal so the air is in direct and unimpeded communication with the roof system at the location immediately adjacent the seal.

2. The apparatus of claim 1 further comprising:

an intake duct mounted between the intake source and the intake port of the blower, the intake duct being configured to selectively draw the quantity of air from at least one of first and second sources.

3. The apparatus of claim 2 further comprising:

a gate mounted within the intake duct for selecting the intake source from at least one of the first and second sources.

4. Apparatus for renewing a roof system of a building, the roof system comprising a deck, an insulation material and a covering, the apparatus being adapted to renew the roof system without substantially removing the covering from the roof system and without substantially separating the covering from the insulation material when installing the apparatus on the roof system, the apparatus comprising a blower having an intake port communicating with an intake source external to the blower and an exhaust port for communicating with the roof system, a housing surrounding the blower having a seal for substantially preventing air from traveling between the blower exhaust port and the roof system covering to escape from the roof system, the blower having an energized state wherein the blower draws air through the intake port and forces the air into the roof system under a sufficient pressure to force the air through the roof system thereby to dry the roof system, and wherein the apparatus is free of conduits internal to the roof system and the air forced into the roof system passes directly into the roof system at a location in the roof system immediately adjacent the seal so the air is in direct and unimpeded communication with the roof system at the location immediately adjacent the seal, and an injection system mounted between the intake source and the exhaust port of the blower for injecting at least one of a fumigant, a fungicide, an algicide and a bactericide into the air being forced into the roof system.

5. Apparatus for renewing a roof system of a building, the roof system comprising a deck, an insulation material and a covering, the apparatus being adapted to renew the roof system without substantially removing the covering from the roof system and without substantially separating the covering from the insulation material during installation of the apparatus onto the roof system, the apparatus comprising:

a housing configured to mount to the roof system, the housing having a seal for extending between the apparatus and the roof system to substantially prevent air from escaping from the roof system;

a blower positioned in the housing for drawing air from an intake source and exhausting the air into the roof system between at least two of the deck, the insulation material and the covering under a sufficient pressure to force the air through the roof system thereby to dry the roof system, and wherein the apparatus is free of conduits internal to the roof system and the air forced into the roof system passes directly into the roof system at a location in the roof system immediately adjacent the housing seal so the air is in direct and unimpeded communication with the roof system at the location immediately adjacent the housing seal;

an intake duct connected to the housing and communicating with an exterior of the building and an interior of the building; and a gate mounted within the intake duct for selecting the intake source from at least one of the exterior and the interior of the building.

6. Apparatus for renewing a roof system of a building, the roof system comprising a deck, an insulation material and a covering, the apparatus being adapted to renew the roof system without substantially removing the covering from the roof system and without substantially separating the covering from the insulation material during installation of the apparatus onto the roof system, the apparatus comprising:

a housing configured to mount to the roof system, the housing having a seal for extending between the apparatus and the roof system to substantially prevent air from escaping from the roof system;

a blower positioned in the housing for drawing air from an intake source and exhausting the air into the roof system between at least two of the deck, the insulation material and the covering under a sufficient pressure to force the air through the roof system thereby to dry the roof system, and wherein the apparatus is free of conduits internal to the roof system and the air forced into the roof system passes directly into the roof system at a location in the roof system immediately adjacent the housing seal so the air is in direct and unimpeded communication with the roof system at the location immediately adjacent the housing seal; and a flashing extending from the housing to the roof system for directing the air exhausted to the roof system.

7. A method of renewing a roof system of a building, the roof system comprising a deck, an insulation material and a first covering, the method comprising the steps of:

blowing air between at least two of the deck, the insulation material and the first covering to dry the roof system; and applying a second covering over the first covering.

8. The method of claim 7 wherein:

the second covering applied over the first covering is a seamless coating.

9. A method of renewing a roof system of a building, the roof system comprising a deck, an insulation material positioned over the deck and a first covering positioned over the insulation material, the method comprising the steps of:

removing an area of the first covering to expose the insulation material;

removing a portion of the insulation material to expose the deck;

blowing air between the first covering and the exposed insulation material and between the insulation material and the exposed deck until the roof system is dried to a predetermined level;

replacing the removed portion of insulation material; and applying a second covering to the first covering of the dried roof system.

10. The method of claim 9 wherein:

the second covering is a seamless coating.

11. The method of claim 9 further comprising the steps of:

cutting a hole through the first covering and the insulation material remote from the removed first covering; and installing an exhaust vent to permit the blown air to escape from the roof system through the vent.

12. The method of claim 9 further comprising the step of:

directing the blown air to a particular section of the roof system by inhibiting the blown air from traveling to another section of the roof system.

13. A method of renewing a roof system of a building, the roof system comprising a deck, an insulation material positioned over the deck and a first covering positioned over the insulation material, using apparatus comprising a blower having an intake port communicating with an intake source external to the blower and an exhaust port for communicating with the roof system, a housing surrounding the blower having a seal for substantially preventing air from traveling between the blower exhaust port and the roof system covering to escape from the roof system, the blower having an energized state wherein the blower draws air through the intake port and forces the air into the roof system under a sufficient pressure to force the air through the roof system thereby to dry the roof system, and wherein the apparatus is free of conduits internal to the roof system and the air forced into the roof system passes directly into the roof system at a location in the roof system immediately adjacent the seal so the air is in direct and unimpeded communication with the roof system at the location immediately adjacent the seal, the method of renewing the roof system being accomplished without substantially removing the covering from the roof system and without substantially separating the covering from the insulation material during installation of the apparatus onto the roof system, the method comprising the steps of:

removing an area of the first covering to expose the insulation material;

removing a portion of the insulation material to expose the deck;

blowing air directly between the first covering and the exposed insulation material and directly between the insulation material and the exposed deck under a sufficient pressure to force air through the roof system thereby to dry the roof system until the roof system is dried to a predetermined level, the blowing being accomplished so that the air forced into the roof system passes directly into the roof system at a location in the roof system immediately adjacent the area from which insulation was removed and so that the air is in direct and unimpeded communication with the roof system at the location immediately adjacent the area of removed insulation;

removing the blower from the roof system;

replacing the removed portion of insulation material; and applying a second covering to the first covering of the dried roof system.

* * * * *